US010550669B1

(12) United States Patent
Rose

(10) Patent No.: US 10,550,669 B1
(45) Date of Patent: Feb. 4, 2020

(54) WELL CELLAR ASSEMBLY WITH ALTERNATE PLATE WELL SLOTS AND METHOD OF USING SAME

(71) Applicant: National Oilwell Varco, L.P., Houston, TX (US)

(72) Inventor: James A. Rose, Murrysville, PA (US)

( * ) Notice: Subject to any disclaimer, the term of this patent is extended or adjusted under 35 U.S.C. 154(b) by 0 days.

(21) Appl. No.: 16/051,527

(22) Filed: Aug. 1, 2018

(51) Int. Cl.
*E21B 43/01* (2006.01)
*E21B 33/03* (2006.01)

(52) U.S. Cl.
CPC ..... *E21B 43/0122* (2013.01); *E21B 33/03* (2013.01)

(58) Field of Classification Search
CPC ..... E21B 43/0122; E21B 33/03
USPC ..... 166/81.1, 96.1, 75.11, 85.2
See application file for complete search history.

(56) References Cited

U.S. PATENT DOCUMENTS 4,291,767 A 9/1981 Hall, Jr.
4,641,708 A 2/1987 Wightman
4,911,244 A 3/1990 Hynes
7,637,692 B1 * 12/2009 Rose ..... E21B 43/0122 166/75.11
7,987,904 B1 8/2011 Rose
8,127,837 B1 3/2012 Rose
8,256,505 B1 9/2012 Rose
8,393,592 B1 * 3/2013 Caron ..... E02D 27/44 249/1
8,485,250 B1 7/2013 Rose
2006/0254778 A1 11/2006 Nobileau
2013/0092397 A1 * 4/2013 He ..... E21B 33/03 166/382
2015/0300110 A1 10/2015 Skinner
2019/0040705 A1 * 2/2019 Stierwalt ..... E21B 33/03

OTHER PUBLICATIONS

Non-Final Office Action for U.S. Appl. No. 14/933,184 dated Jan. 10, 2017.
Non-Final Office Action for U.S. Appl. No. 14/933,184 dated May 23, 2018.
Final Office Action for U.S. Appl. No. 14/933,184 dated Nov. 19, 2018.
Non-Final Office Action for U.S. Appl. No. 14/612,007 dated Dec. 8, 2016.
Final Office Action for U.S. Appl. No. 14/612,007 dated Sep. 6, 2017.
Non-Final Office Action for U.S. Appl. No. 14/612,007 dated Apr. 16, 2018.
International Search Report and Written Opinion of the International Searching Authority for PCT Application PCT/US2019/044683 dated Sep. 12, 2019.

* cited by examiner

*Primary Examiner* — James G Sayre
(74) *Attorney, Agent, or Firm* — David G. Oberdick; Michael G. Monyok

(57) ABSTRACT

A well cellar assembly, and a method of using same, with the well cellar including a base plate, the base plate having at least two well slot openings therein for receiving a conductor pipe, and at least one vertically extending side wall connected to the base plate with a fluid tight seal. The at least two well slot openings provide alternative locations for the conductor pipe and at least one of the at least two well slot openings is selected for placement of the conductor pipe.

16 Claims, 6 Drawing Sheets

WELL CELLAR ASSEMBLY WITH ALTERNATE PLATE WELL SLOTS AND METHOD OF USING SAME

STATEMENT REGARDING FEDERALLY SPONSORED RESEARCH

Not applicable.

BACKGROUND OF THE APPLICATION

In the field of oil and gas exploration/production, a well cellar can be positioned below ground level underneath a drilling rig. A well is drilled within the well cellar. The present application is directed to containment well cellars of the types generally described and claimed in U.S. Pat. Nos. 7,637,692, 7,987,904, 8,127,837, 8,256,505, and 8,485,250, each of which is hereby incorporated by reference in its entirety. These well cellars also may contain equipment such as blow out preventers, valves, and other equipment associated with drilling, completion and other well operations.

Outside of the well cellar designs described and claimed in the above-noted patents, other well cellars often are made only from a section of steel culvert pipe installed in the ground with a dirt floor. These other designs provide no protection against fluid spills that can arise during drilling operations. More specifically, during drilling, completion and other well operations, fluids from the drilling rig and production equipment, such as lubricants, drilling mud, completion fluids, and oil, can leak or spill into and out of the well cellar. These spills can create ecological problems, polluting soil samples as well as surface and subsurface aqueous sources. Such corrupted soil areas must be remediated before a well is capped, adding expense to taking an under-producing well off-line.

In the well cellars associated with the present application, the well conductor pipe extends through a well slot in the floor or base plate of the well cellar into the underlying subterranean formation. Preferably, the conductor pipe is cemented into place and then sealed to the floor or base plate to protect against fluid spills during operation. Preferably, the floor or base plate is also sealed to the wall or walls of the well cellar so that the walls not only provide structural support to prevent collapse of the surrounding earth onto the equipment, but also act to protect against fluid spills as well.

Many well pads have multiple parallel rows of wells, and equipment access to the wells is part of the layout planning. Where well cellars with floor or base plates, as described above, are used for such well pads, and the floor or base plates have predetermined or fixed locations for well slots into which a conductor pipe is placed, a need has arisen for an installation process that facilitates well pad construction and layout options for the operator (i.e., the customer).

BRIEF SUMMARY OF THE APPLICATION

The well cellar of the present application allows for below grade well head installations and also for installation of the conductor pipe after underground installation of the well cellar through what is described as a "Dril-Thru" process. In particular, in the Dril-Thru process, the well cellar of the present application has a floor or base plate with a predetermined location of a slot or slots for installation of a conductor pipe. The well cellar is first installed at a desired location, and, after installation, the conductor pipe is installed through the floor or base plate of the well cellar.

In this context, it is preferable to have multiple slot locations within the floor or base plate of the well cellar to provide options for equipment access, piping, and worker access. Alternate well slots within a single well cellar allow the customer to plan wellbore access from any direction. The alternate slot locations also facilitate an ambidextrous or flexible design of the internal features and equipment within the cellar—that is, the alternate slots allows for reversal of the location of the conductor pipe within the well cellar. As a result, the alternate locations of the well slots give the operator complete flexibility in pad development and well maintenance.

In one embodiment, the alternate well slots of the present application overlap or intersect in the form of a Venn diagram (where two well slots overlap or intersect, a "Figure 8" figure is formed), and the conductor pipe is installed in a desired well slot, after placement of the well cellar below ground, through interaction with a conductor cement bushing that mounts within the desired well slot and has a central opening to hold and center the conductor pipe while the conductor pipe is cemented into place. In addition, the assembly of the present application can have an adaptor plate that slides over the conductor pipe after the conductor pipe is cemented into place. The adaptor plate has a shape and surface area that covers all open holes or spaces in the base plate, including the well slot not selected and spacing between the selected well slot and the conductor pipe, and the plate is welded or otherwise sealed to the conductor pipe and the base plate of the well cellar to create leak-proof seal while also making a structural connection between the well cellar and the conductor pipe, whereby the base plate of the well cellar provides load-bearing support and stabilization to the conductor pipe.

While the alternate slot location concept of the present application is particularly useful with the Dril-Thru process, the alternate slot locations also can be used with other well cellar installation processes.

Various other features, advantages, and characteristics of the present application will become apparent after a reading of the following detailed description.

DETAILED DESCRIPTION OF THE APPLICATION

Figure 1:
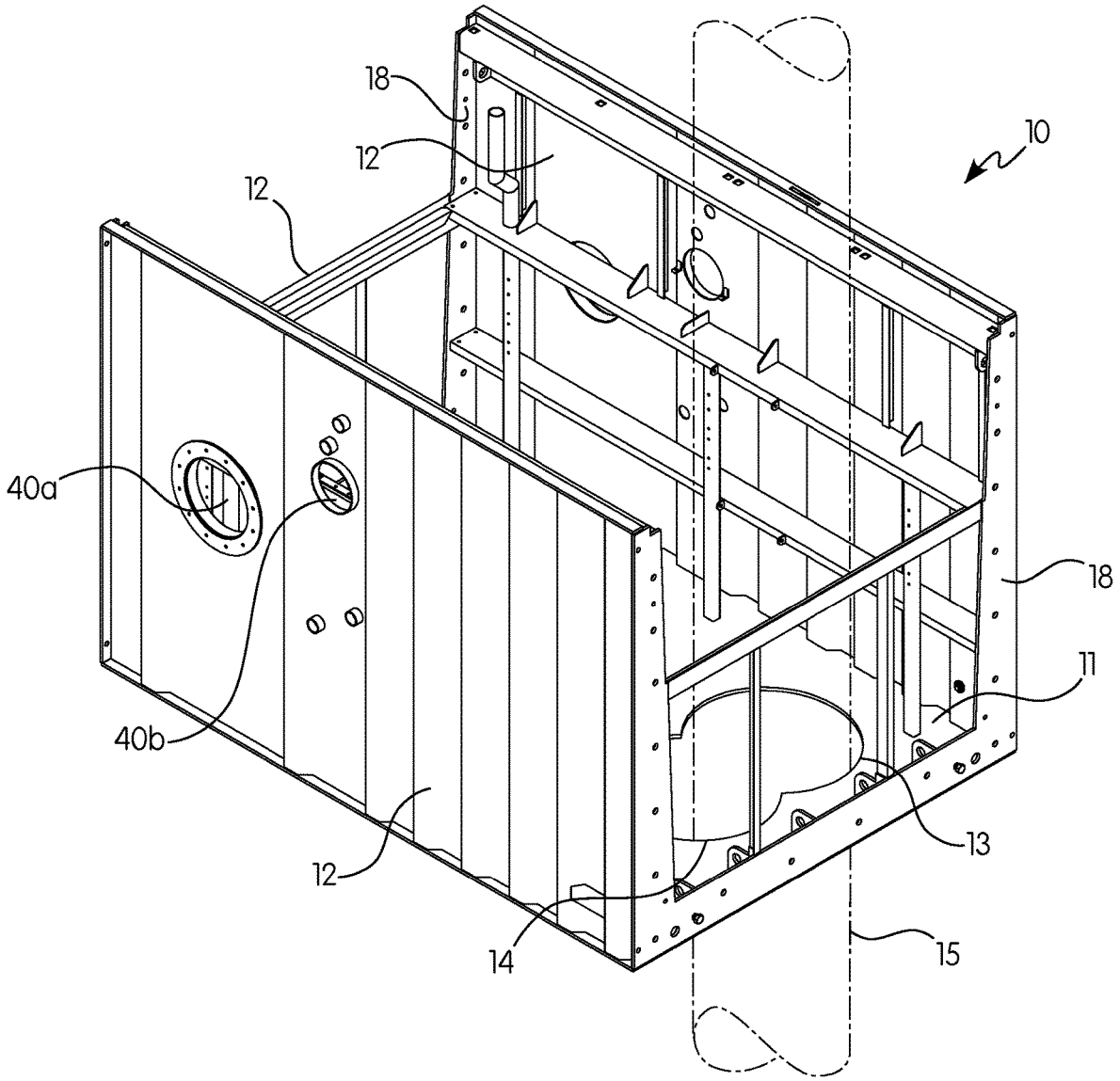
FIG. 1 is a side perspective view of one embodiment of the present application.
Figure 2:
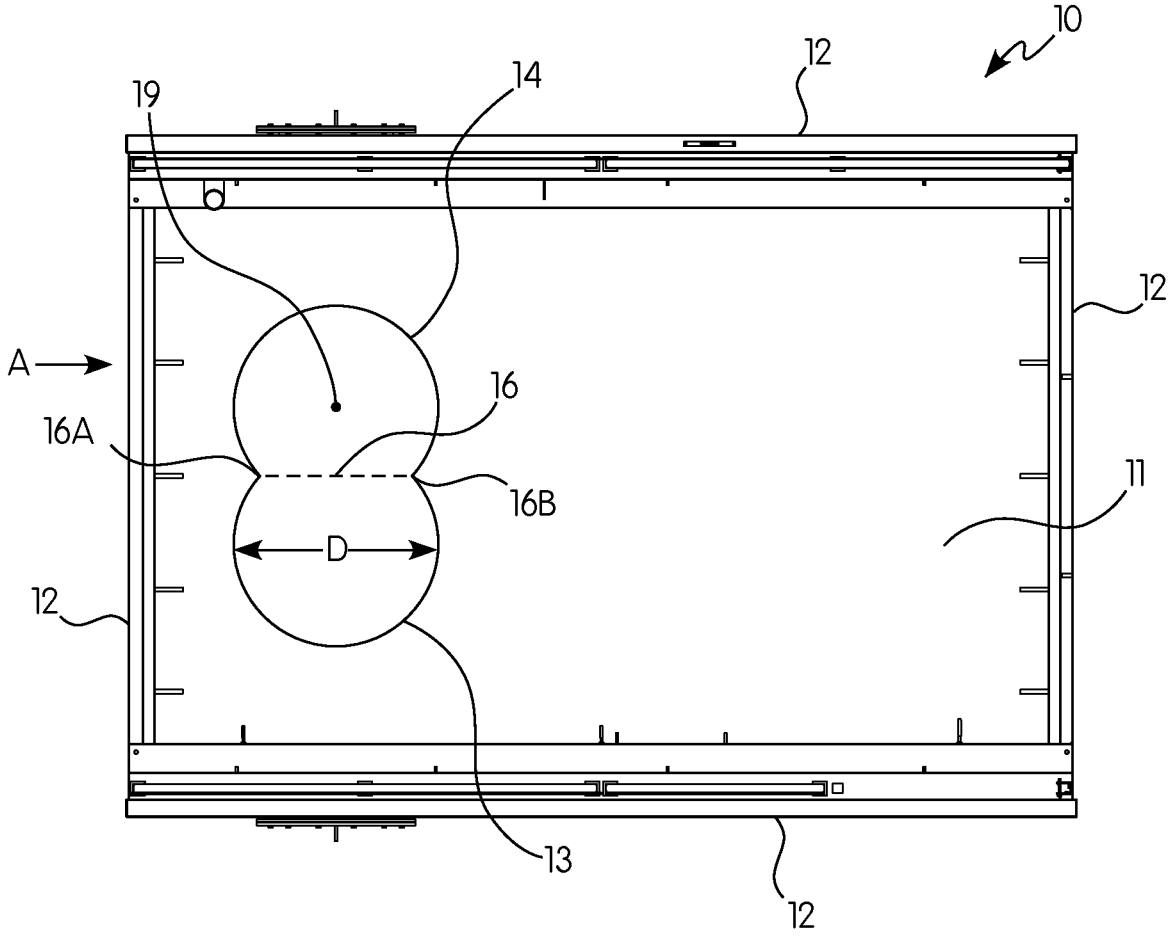
FIG. 2 is a top view of one embodiment of the present application.
Figure 6:
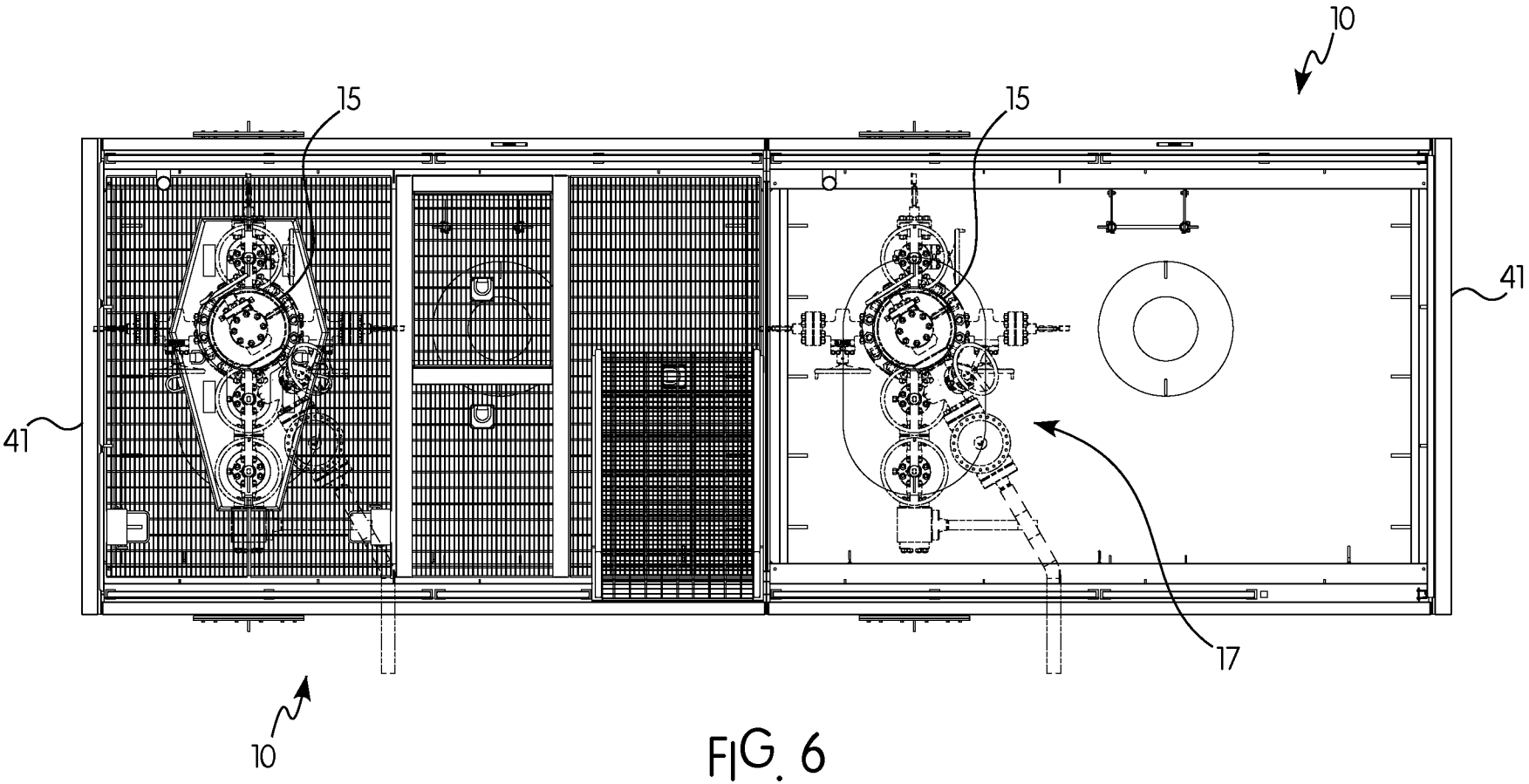
FIG. 6 is a top view of two side by side well cellars of the present application.

Referring to FIGS. 1 and 2, the alternate well slots within a well cellar of the present application are shown. In particular, FIGS. 1 and 2 depict a well cellar 10 with a floor or base plate 11. In one embodiment, floor or base plate 11 is welded or otherwise sealed in a fluid-tight manner to the one or more vertical side walls of well cellar 10. The shape, size and dimension of well cellar 10 can vary to facilitate the specific operational plans of a user or customer. In particular, while a box-shaped well cellar 10 is shown in FIGS. 1 and 2, the well cellar of the present application can be round or circular and have one continuous side wall. The well cellar of the present application also can have more than four side walls with, for example, the shape of a pentagon, hexagon or octagon, among others. The forward wall of well cellar 10 in FIG. 1 has been removed in order to show the inner area of well cellar 10. As shown further in FIG. 6, well cellar 10, as depicted in FIG. 1, can operate, in one embodiment, as a modular trench cellar or unit that can be extended to connect to two or more well cellars together through connectable frame members 18. In one embodiment, connectable frame members 18 are U-shaped, are located opposite each other, and are bolted or otherwise connected to the corresponding U-shaped frame member 18 of the adjoining well cellar 10, without a central wall between them, as shown in FIG. 6. The end well cellar 10 in a series of well cellars 10 can have a wall or door 41 mounted on the external U-shaped frame 18. Connectable frame members 18 also can be located, in other embodiments, in adjoining wall sections of well cellar 10 in order to form angled modular connections or well rows of varying lengths and configurations as may be desired. In the modular well cellars 10 shown in FIGS. 1 and 6, well cellars 10 also can have apertures 40*a* and 40*b* of varying predetermined sizes and locations for use with well accessories 17.

Alternate slots 13 and 14 are located in well cellar floor or base plate 11 and one of alternate slots 13 and 14 operate to receive conductor pipe 15. Alternate slots 13 and 14 have a predetermined diameter D that can vary depending upon the size of the conductor pipe 15 and the bit size necessary to install the alternate slots 13 and 14. In this respect, alternative slots 13 and 14 provide options for equipment access, piping, and worker access. Further, alternate well slots within a single well cellar allow the customer to plan wellbore access from any direction. The alternate slot locations also facilitate an ambidextrous or reversible design of the internal features of the cellar—that is, the alternate slots allows for reversal of the location of the conductor pipe within the well cellar. As such, the alternate locations of the well slots give the operator complete flexibility in pad development and well maintenance. For example, and as shown in FIG. 6, well cellars 10 can be installed side by side in a well pad. In each well cellar 10, conductor pipe 15 has been installed in an alternate well slot in the floor plate that is positioned similar to well slot 14 in FIG. 2. This placement allows for orientation of well accessories 17 around conductor pipe 15 and the associated well hole. Depending upon the layout of the well pad, conductor pipe 15 could also be located in the well slot corresponding to the location of well slot 13 shown in FIG. 2.

In one embodiment involving two alternate slots, alternate slots 13 and 14 overlap or intersect to form a Venn diagram or "Figure 8" shape—as opposed to a uniform oval-shaped slot—as shown in FIG. 2. This overlapping configuration of slots 13 and 14 allows for a relatively close, but flexible, positioning of the conductor pipe 15. The exact amount of overlap or intersection between alternate slots 13 and 14 is predetermined as part of the design process of the well cellar and based on input from and knowledge of the lay-out plans of the customer or use of the well cellar. For example, but without limitation, the center 19 of alternate well slots can be located at about 10 to 12 inches from the center line or waistline 16, as shown in FIG. 2. The distance between center 19 and center line or waistline 16 can vary in other embodiments. In another embodiment, alternate well slots 13 and 14 can be separate and not overlapping.

Figure 3:
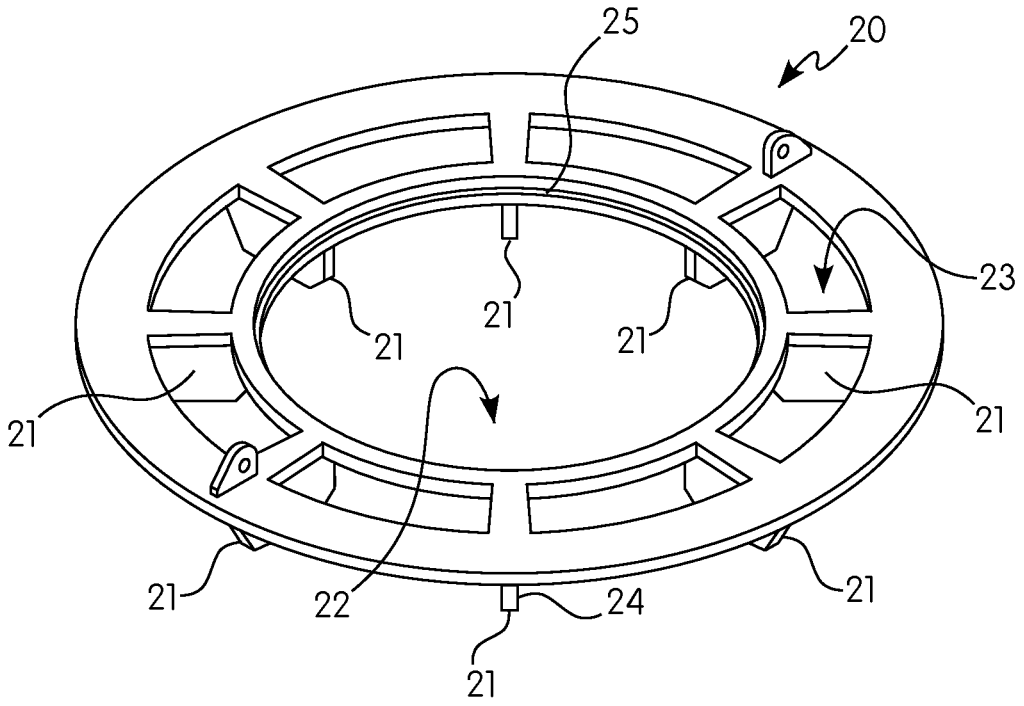
FIG. 3 is a top perspective view of a conductor cement bushing for use with the present application.
Figure 3A:
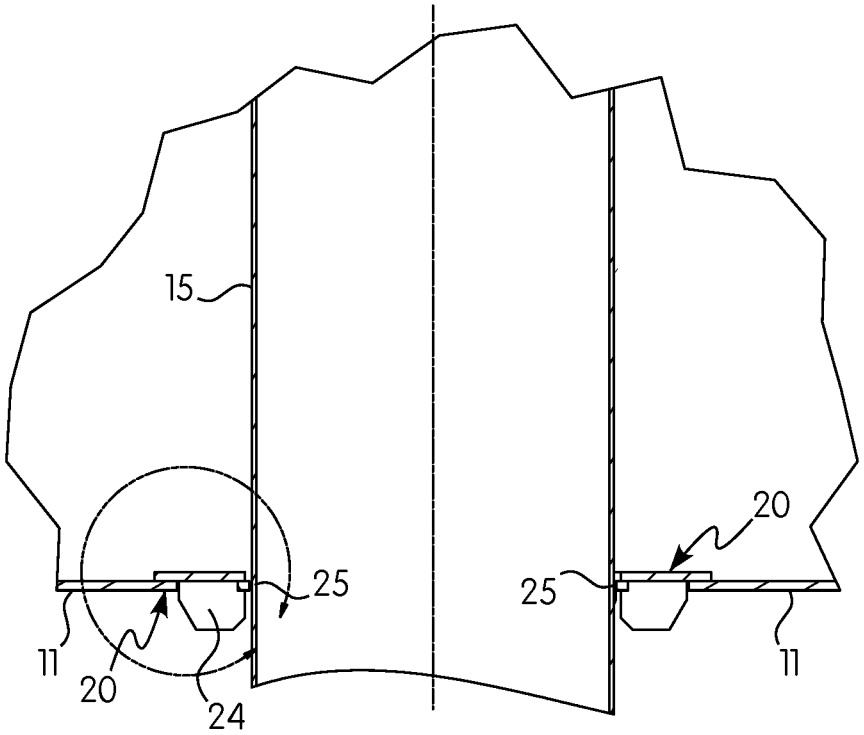
FIG. 3A is a side cut-away view of the conductor cement bushing in FIG. 3.
Figure 3B:
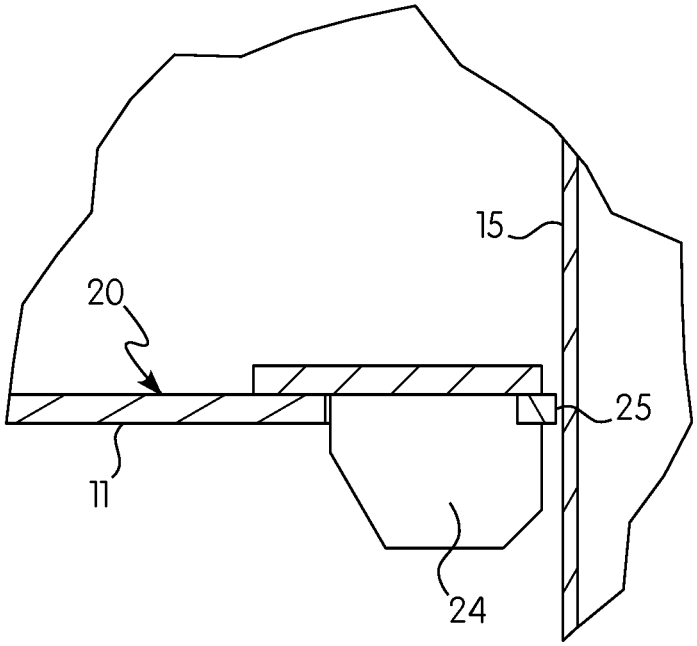
FIG. 3B is one-half of the side cut-away view of the conductor cement bushing in FIG. 3A.

The overlapping configuration of alternate slots 13 and 14, or "Figure 8" design provides a "waist line" 16 between indented points 16A and 16B that aids in centering and aligning conductor pipe 15 so that piping and other components will line up correctly. Specifically, the "Figure 8" shape of the alternate slots 13 and 14 allow, in a further embodiment of the assembly of the present application, a "fit for purpose" conductor cement bushing 20 (as shown in FIGS. 3, 3A and 3B) to be installed in one of the desired slots 13 or 14. The central opening 22 of bushing 20 has a central opening 22 that is configured to receive conductor pipe 15, whereby conductor pipe 15 is centered for cementing. More specifically, bushing 20 has an inner ledge 25 that serves as a fulcrum point for adjusting the location of the bottom of conductor pipe 15 to achieve a predetermined angle measured from vertical or "plumbness" with respect to the well hole. Once the plumbness of conductor pipe 15 is adjusted, cement is poured or pumped into one or more openings 23 that are located inside the outer circumference of the bushing 20. In one embodiment, where a plurality of openings 23 exists in bushing 20, openings 23 are arranged in a symmetrical pattern inside the outer circumference of the bushing 20. The openings 23 can also have an asymmetrical pattern. Bushing 20 is made of a hard material, such as steel.

In operation, cement is pumped through a grout tube extending through one of the openings 23 and to the bottom of the conductor hole (typically around one hundred feet). The grout then fills up the annulus between the wall of the well or conductor hole and the outside diameter of the conductor pipe 15. This process of pumping the grout from the bottom up assures that water is displaced entirely with cement in the annulus between the wall of the conductor hole and the outside diameter of the conductor pipe 15. In cases where ground water is not present, the grout may be poured or pumped directly through openings 23 and without a grout tube extending to the bottom of the well hole.

The underside of bushing 20 has a plurality of fins 21 arranged in a circular symmetric pattern inside the outer circumference of the bushing 20 in one embodiment. Again, an asymmetrical pattern also can be used. Fins 21 act to fit bushing 20 down into the desired well slot 13 or 14 and, in turn, center the bushing 20 and conductor pipe 15 within well slot opening 13 or 14. The outside edges 24 of fins 21 on bushing 20 are located to contact as much of a slot opening 13 or 14 as possible; preferably, seven of the eight fins 21 shown in FIGS. 3, 3A and 3B are contacting a portion of its respective slot opening. The "waist line" 16 of the "Figure 8" orientation of slots 13 and 14 allows for this interaction between a selected slot 13 or 14 and fins 21 of the bushing 20. Without "waist line" 16, such as in the case of an extended slot or oval, bushing 20 would be free to move in one dimension and not stay centered. The dimensions of bushing 20 can vary, as can the number of fins 21.

In alternative embodiments, three or more overlapping slots can be used, with multiple waistlines 16 formed between each pair of slots. For example, three overlapping slots can form a triangular design and present three location options for conductor pipe 15. The location of the slots within the floor or base plate of the well cellar can also vary. In FIGS. 1 and 2, for example, slots 13 and 14 are proximate to side A. Depending upon the size and shape of the well cellar 10, slots 13 and 14 can be centrally located or positioned elsewhere in floor or base plate 11. Also, in a large well cellar 10, two or more sets of alternative well slots can be used, with one slot selected from all of the available alternative well slots.

Figure 4:
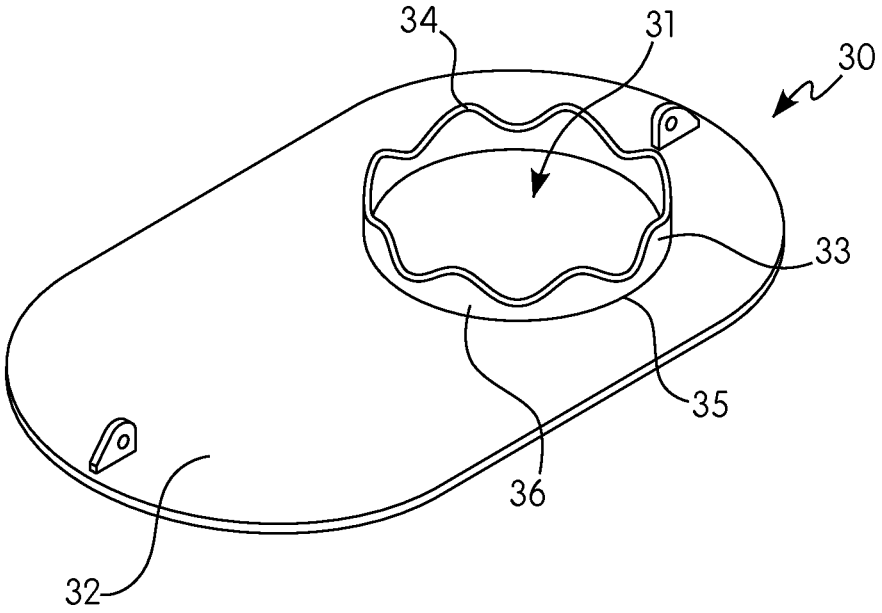
FIG. 4 is a top perspective view of an adaptor plate for use with the present application.
Figure 5:
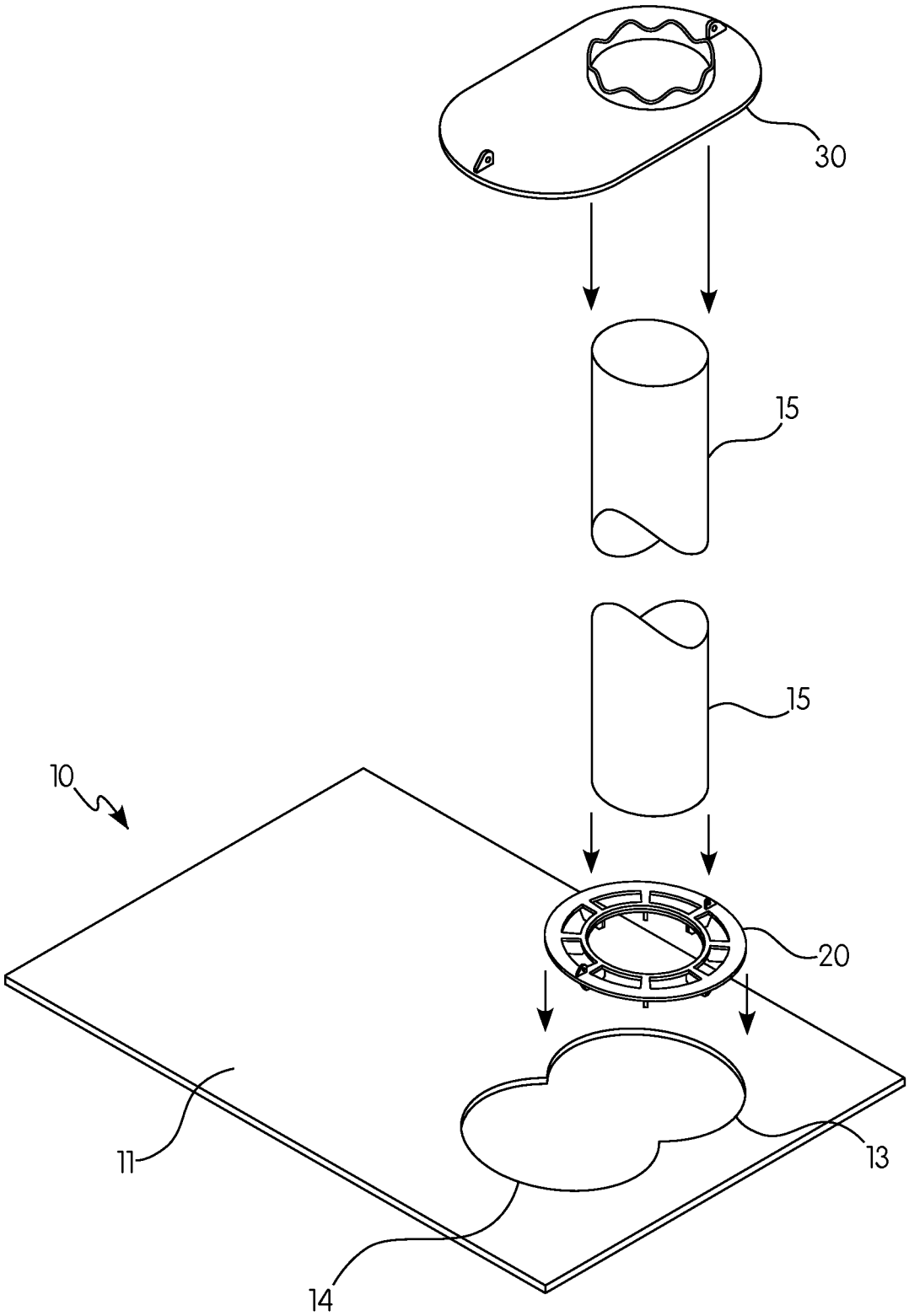
FIG. 5 is a top perspective view of one embodiment of the present application showing the interaction between the floor plate, conductor pipe, conductor cement bushing, and adaptor plate.

The well slot assembly of the present application also can include an adaptor plate 30. After conductor pipe 15 is cemented into place, bushing 20 is removed by sliding bushing 20 over conductor pipe 15, and opening 31 of adapter plate 30 (as shown in FIG. 5) is slid over conductor pipe 15. Preferably, adapter plate 30 has a shape and surface area that includes closed portion 32. As shown in FIG. 4, adapter plate 30 can have an oval shape, but other shapes can be used as well. The closed portion 32 of adapter plate 30 is positioned over the slot 13 or 14 that did not receive conductor pipe 15. The adapter plate 30 is then welded or otherwise sealed in a fluid tight manner to the floor or base plate 11 of well cellar 10 and also to conductor pipe 15, and this welding or sealing creates a leak-proof seal while also forming a structural and load-bearing connection between the well cellar 10 and the conductor pipe 15. In one embodiment, adaptor plate 30 has a raised upper ring or tube section 33 above opening 31, with a wavy or scalloped upper edge 34. The bottom edge 35 of ring 33 is attached to adaptor plate 30 in a fluid-tight manner, such as by welding. The wavy edge 34 of ring 33 helps assure that one cross section of the sealed or welded connection between adaptor plate assembly 30 and conductor pipe 15 is fully complete, e.g., it has a 100% weld. More specifically, ring 33 increases the connection or weld area between adaptor plate 30 and conductor pipe 15, by allowing a welder to bend in the upper tabs 36 and thereby reduce the gap between the conductor pipe 15 and ring 33 and, in turn, inhibiting a crack from growing all the way around the conductor pipe 15.

In operation, and referring to FIG. 5, the alternative well slot assembly of the present application is used in the manner described above. In particular, after a hole is dug for placement of well cellar 10, well cellar 10 is installed and oriented in a manner to present a desired location for alternate slots 13 and 14. A well hole is then dug within the selected alternate slot 13 or 14 for placement of conductor pipe 15. In one embodiment, conductor cement bushing 20 is then placed on either of alternate slots 13 or 14 (depending upon which will received conductor pipe 15). Conductor pipe 15 is then lowered and inserted through the central hole 22 of bushing 20, the internal ledge 20 of bushing 20 is used to align the conductor pipe, and the conductor pipe 15 is cemented into place. In particular, internal ledge 20 projects inward within central hole 22 and acts as a fulcrum against which conductor pipe 15 is moved so that the bottom of conductor pipe 15 aligns correctly at the bottom of the well hole. In an alternative embodiment, conductor pipe 15 is lowered into either of alternate slots 13 or 14, and conductor cement bushing 20 then is slid over conductor pipe 14 and fitted into the corresponding slot. The internal ledge 28 of bushing 20 is again used as a fulcrum to align conductor pipe before cementing. After cementing, bushing 20 is removed. Adapter plate 30 next is slid over conductor pipe 15 and the adapter plate 30 is then welded or otherwise sealed to the floor or base plate 11 of well cellar 10 and conductor pipe 15.

Various changes, alternatives, and modifications will become apparent to a person of ordinary skill in the art after a reading of the foregoing specification. It is intended that all such changes, alternatives, and modifications as fall within the scope of the appended claims be considered part of the present application.

What is claimed is:

1. A well cellar assembly with alternate base plate well slots for receiving a well conductor pipe, the assembly comprising a base plate forming a floor of the well cellar assembly, the base plate having at least two well slot openings therein for receiving the conductor pipe;

at least one vertically extending side wall connected to the base plate with a fluid tight seal; and a conductor cement bushing adapted to be mounted in at least one of the at least two well slot openings, the conductor cement bushing having an interior opening to receive the well conductor pipe;

wherein the at least two well slot openings provide alternative locations for the conductor pipe.

2. The well cellar assembly of claim 1, wherein the at least two well slot openings overlap.

3. The well cellar assembly of claim 2, wherein the at least two well slot openings overlap to form a "Figure 8."

4. The well cellar assembly of claim 2, further comprising a ring adaptor plate slid over the conductor and connected with a fluid tight seal to the conductor and the base plate.

5. The well cellar assembly of claim 4, wherein the fluid tight seal is a weld and forms a structural connection between the well cellar and the conductor.

6. The well cellar assembly of claim 1, wherein the fluid tight seal is a weld.

7. The well cellar assembly of claim 1, wherein the conductor cement bushing comprises one or more holes located inside an outer circumference of the conductor cement bushing for use in receiving cement to cement the conductor pipe in place.

8. The well cellar assembly of claim 1, wherein the assembly is modular and has at least one connectable frame member to allow connection to an adjacent modular well cellar.

9. The well cellar assembly of claim 1, wherein the conductor cement bushing comprises a plurality of radial fins, wherein an outside edge of at least a portion of the plurality of radial fins contacts the slot opening.

10. A method of using a well cellar assembly with a base plate and at least one well slot opening in the base plate for receiving a well conductor pipe after the well cellar assembly is installed in the ground, the at least one well slot opening having a predetermined location, and the method comprising the steps of:

a) Drilling a well hole through the at least one well slot opening;

b) Inserting the conductor pipe through the at least one well slot opening and into the well hole;

c) Mounting a conductor cement bushing on the at least one well slot opening before or after insertion of the conductor pipe into the at least one well slot opening, the conductor cement bushing having a central opening to hold and center the conductor pipe;

d) Cementing the conductor pipe into place; and e) Sliding an adaptor plate over the conductor pipe, with the conductor pipe passing through an internal opening in the adaptor plate, and connecting the adaptor plate to the conductor pipe and the floor plate with a fluid tight seal.

11. The method of claim 10, wherein the base plate has at least two well slot openings.

12. The method of claim 11, where the at least two well slot openings overlap.

13. The method of claim 12, wherein the at least two well slot openings overlap to form a "Figure 8."

14. The method of claim 10, wherein the fluid tight seal is a weld.

15. The method of claim 14, wherein the weld forms a structural connection between the well cellar and the conductor pipe.

16. The method of claim 10, wherein the conductor cement bushing also includes one or more holes located inside the outer circumference of the conductor cement bushing for use in receiving the cement to cement the conductor pipe into place.

* * * * *